US010125425B2

(12) United States Patent
Ward, Jr. et al.

(10) Patent No.: US 10,125,425 B2
(45) Date of Patent: Nov. 13, 2018

(54) METHOD FOR SMUT REMOVAL DURING STRIPPING OF COATING

(71) Applicant: GENERAL ELECTRIC COMPANY, Schenctady, NY (US)

(72) Inventors: John David Ward, Jr., Woodruff, SC (US); Liming Zhang, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 585 days.

(21) Appl. No.: 13/932,394

(22) Filed: Jul. 1, 2013

(65) Prior Publication Data

US 2015/0000696 A1 Jan. 1, 2015

(51) Int. Cl.
*C23G 1/02* (2006.01)
*C23F 1/20* (2006.01)
(Continued)

(52) U.S. Cl.
CPC ..... *C23G 1/02* (2013.01); *C23F 1/20* (2013.01); *C23F 1/28* (2013.01); *C23F 1/44* (2013.01); *C23G 1/20* (2013.01); *F01D 5/005* (2013.01)

(58) Field of Classification Search
None
See application file for complete search history.

(56) References Cited

U.S. PATENT DOCUMENTS 2,696,364 A 12/1954 Bartlett
3,380,921 A * 4/1968 Goodspeed ..... C23G 1/19 134/2
(Continued)

FOREIGN PATENT DOCUMENTS

EP 1136593 A1 9/2001
EP 2565295 A1 3/2013
(Continued)

OTHER PUBLICATIONS

Giolli et al (TBC Dry Ice Stripping), May 1, 2010, International Themal Spray Congress, cover and figure tittled "TBC Stripping and Rework Process Comparison".*
European Search Report and Written Opinion issued in connection with corresponding EP Application No. 14174689.1-1362 dated Nov. 20, 2014.

*Primary Examiner* — Gordon Baldwin
*Assistant Examiner* — Mohammad Mayy
(74) *Attorney, Agent, or Firm* — McNees Wallace & Nurick LLC

(57) ABSTRACT

Stripping a metallic bond coat from an article using a wet chemical process. An article removed from service and having a metallic bond coat applied over a surface of its metallic substrate is provided. The metallic bond coat is used to improve the adhesion of a TBC to the article, so grit blasting to first remove any TBC applied over the bond coat and which still remains on the article initially may be required. The bond coated article is then immersed in an acid solution of $HCl/H_3PO_4$ at a predetermined temperature for a predetermined amount of time, the $HCl/H_3PO_4$ solution reacting with the bond coat applied over the metallic substrate to form a smut on the surface. The article is then removed from the $HCl/H_3PO_4$ solution and quickly immersed in a solution of NaOH for a predetermined amount of time to at least partially desmut the surface.

30 Claims, 3 Drawing Sheets

(51) Int. Cl.

| | |
|---|---|
| ***C23F 1/28*** | (2006.01) |
| ***C23F 1/44*** | (2006.01) |
| ***C23G 1/20*** | (2006.01) |
| ***F01D 5/00*** | (2006.01) |

(56) References Cited

U.S. PATENT DOCUMENTS

| | | | | | |
|---|---|---|---|---|---|
| 3,905,909 | A * | 9/1975 | Bauer | C11D 7/06 | 134/2 |
| 3,988,254 | A | 10/1976 | Mori | | |
| 4,619,707 | A | 10/1986 | Hirschmeier et al. | | |
| 5,182,006 | A | 1/1993 | Haydu et al. | | |
| 5,336,425 | A | 8/1994 | Aoki et al. | | |
| 5,382,295 | A | 1/1995 | Aoki et al. | | |
| 5,437,887 | A | 8/1995 | Yarkosky et al. | | |
| 5,896,664 | A | 4/1999 | Tsuji et al. | | |
| 6,080,447 | A | 6/2000 | Ferroni et al. | | |
| 6,099,655 | A | 8/2000 | Farr et al. | | |
| 6,494,960 | B1 * | 12/2002 | Macdonald | C23F 1/20 | 134/28 |
| 6,645,306 | B2 | 11/2003 | Madi et al. | | |
| 6,664,019 | B2 | 12/2003 | Zaloom et al. | | |
| 6,743,350 | B2 * | 6/2004 | Lee | B23H 9/16 | 205/640 |
| 7,115,717 | B2 | 10/2006 | Powers et al. | | |
| 7,270,764 | B2 | 9/2007 | Wustman et al. | | |
| 7,687,449 | B2 | 3/2010 | Powers et al. | | |
| 2003/0082297 | A1 * | 5/2003 | Wolkers | B23P 6/002 | 427/140 |
| 2009/0162209 | A1 * | 6/2009 | Wortman | F01D 5/187 | 416/241 R |

FOREIGN PATENT DOCUMENTS

| | | | | |
|---|---|---|---|---|
| JP | 2004018977 | A | 1/2004 | |
| WO | WO 03089679 | A1 * | 10/2003 | C23C 4/005 |

* cited by examiner

METHOD FOR SMUT REMOVAL DURING STRIPPING OF COATING

FIELD OF THE INVENTION

The present invention is directed to desmutting an article during metal bond coat removal.

BACKGROUND OF THE INVENTION

Removal of metallic coatings as part of refurbishment efforts for articles removed from service requires time consuming operations. A current method for removal of metallic coatings requires smut removal after an initial grit blast for articles removed from turbine service. Smut is formed by an initial acid bath immersion, the acid bath interacting with the metallic coating. The smut formed is tightly adherent. The tightly adherent smut is then removed by at least two additional cycles of grit blasting, masking of cooling holes to prevent acid from entering the cooling holes during subsequent dip and re-dipping until the smut is removed.

The current method requires at least three grit blasting operations per stripping cycle and at least two acid stripping cycles, the acid stripping being accomplished by very strong acids, such as 20-40 weight percent nitric acid. Masking of sensitive portions of the substrate may be necessary to prevent damage either by overexposure to the chemicals or to the grit blasting operations. The additional grit blasting to remove the smut formed by the acid dip increases the risk of over-blasting, which could undesirably remove substrate material from the article and possibly removing additional substrate material during subsequent acid dips. Some methods may utilize an elevated caustic treatment at temperatures of 140° F. (60° C.) or higher. In addition to the possibility of damaging the substrate materials, the high concentrations of acid, the multiple grit blasting operations and, when used, the high temperatures of the caustic treatments create environmental, health and safety (EHS) concerns as a result of the chemicals and the multiple frit blasting operations.

What is needed is method that can remove the smut formed by exposure to an acid bath during refurbishment of a coated article removed from service, such as a coated turbine component, which reduces the possibility of damage to the substrate while minimizing exposure of the article and personnel to chemicals that may create EHS concerns.

SUMMARY OF THE INVENTION

Stripping a metallic bond coat from an article using a wet chemical process is set forth herein. In its broadest embodiment, an article such as a turbine component removed from service and having a metallic bond coat applied over a surface of its metallic substrate is provided. The metallic bond coat is used to improve the adhesion of a thermal barrier coating to the component, so the article may require grit blasting to first remove any thermal barrier coating (TBC) that may have been applied over the bond coat and which still remains on the article. The bond coated article may then be immersed in a solution of $HCl/H_3PO_4$ at a predetermined temperature for a predetermined amount of time, the $HCl/H_3PO_4$ solution reacting with the bond coating applied over the metallic substrate to form a smut on the surface. The article is then removed from the $HCl/H_3PO_4$ solution and quickly immersed in a solution of NaOH for a predetermined amount of time to at least partially desmut the surface.

The article is again immersed in a solution of $HCl/H_3PO_4$ at a predetermined temperature for a predetermined amount of time, the $HCl/H_3PO_4$ solution reacting with the smut and any remaining bond coating still adhering to the metallic substrate on the surface. The solution is then removed from the solution of $HCl/H_3PO_4$ and immersed in a solution of NaOH. The article is then removed from the NaOH solution, wiped and contacted with water. The water serves to remove residual loose material on the surface of the turbine component as well as to neutralize the basic solution, while wiping serves to remove any residual smut that is slightly more adherent.

The surface of the turbine component is then inspected to verify that the bond coat has been effectively removed from the surface of the metallic substrate. The bond coat-free turbine component may then be refurbished as required for reuse in a turbine engine.

The method set forth above enables smut removal in a shorter period of time than previously used methods. This results in lower costs and higher turn-around for coating removal. The operation also eliminates the additional grit blasting steps previously used to remove coating material.

The process of the present invention utilizes a relatively mild acid bath of $HCl/H_3PO_4$ that reacts with a bond coat to generate a smut that may be removed by subsequent immersion in a relatively mild solution of NaOH, which surprisingly removes the smut more quickly than prior art grit blasting methods, which grit blasting has been sufficiently aggressive to result in removal of substrate material and scrapping of buckets.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

In the description of the invention, the article may be referred to as a turbine component and the coating layer overlying the turbine component is referred to as a metallic bond coat. The turbine component which forms the substrate for overlying coatings, most frequently are nickel base and cobalt base superalloys, selected because of their superior high temperature mechanical properties as well as their corrosion and oxidation resistance. The coating layer or metallic bond coat is an intermediate coating overlying the substrate and between the substrate and a thermal barrier coating (TBC) which is separate and distinct from the metallic bond coat. These descriptions are not intended to be limiting. Other articles having metallic bond coats may be stripped according to the process set forth herein. The term metallic bond coat includes a variety of metallic materials applied to a substrate material to improve adherence of top coat materials while imparting high temperature oxidation resistance to the substrate materials comprising metallic alloys. Non-limiting examples of such metallic bond coat materials include coatings of diffusion aluminides and overlay aluminides, such as nickel aluminides (NiAl), platinum aluminides (PtAl), NiPtAl, as well as MCrAlX, where M is an element selected from the group consisting of nickel (Ni), cobalt (Co), iron (Fe) and combinations thereof and X is an element selected from the group of solid solution strengtheners and gamma prime formers consisting of Y, Ti, Ta, Re, Mo and W and grain boundary strengtheners consisting of B, C, Hf and Zr and combinations thereof. The term aluminide bond coat is used generally to refer to any of these metallic coatings commonly applied to superalloy and high temperature turbine buckets or blades. As used herein, the term "selective removal" of the aluminide coating refers to the removal of a relatively large percentage of the aluminide material and smut while removing only a very small portion or none of the base (substrate) material and is separate and distinct from removal of thermal barrier coatings that may overlie the aluminide bond coat.

Figure 1:
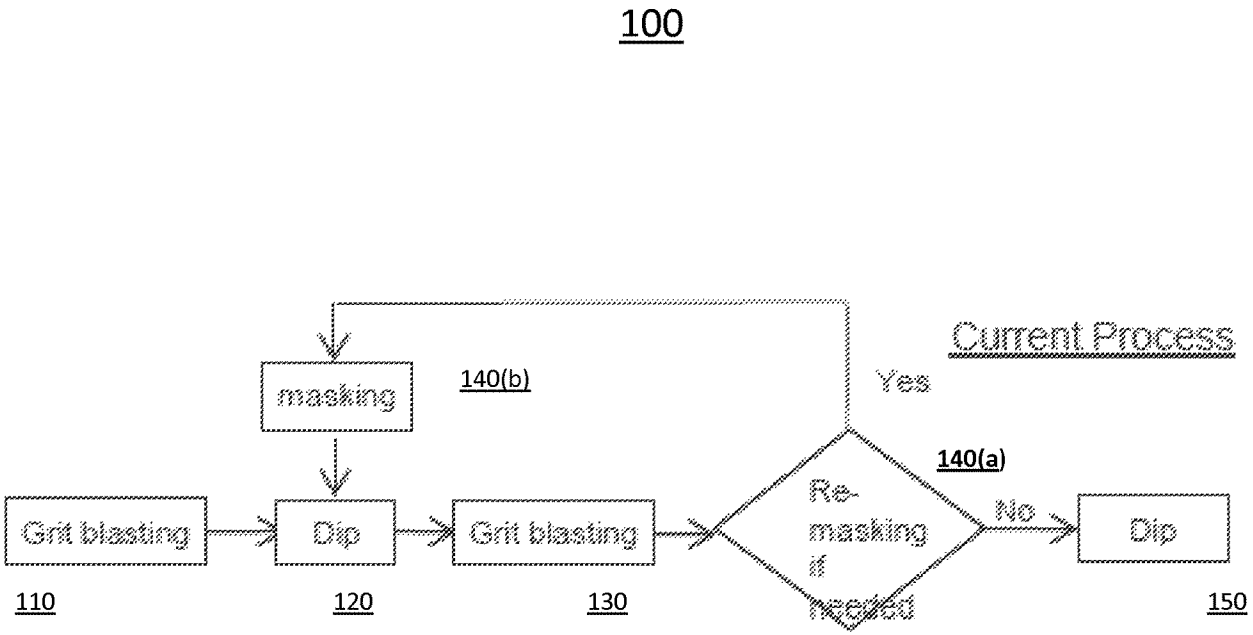
FIGURE 1 PRIOR ART
FIG. 1 is a diagram of the current process for removing from article substrates coated with a bond coat using a strong acid and a strong caustic.
Figure 3:
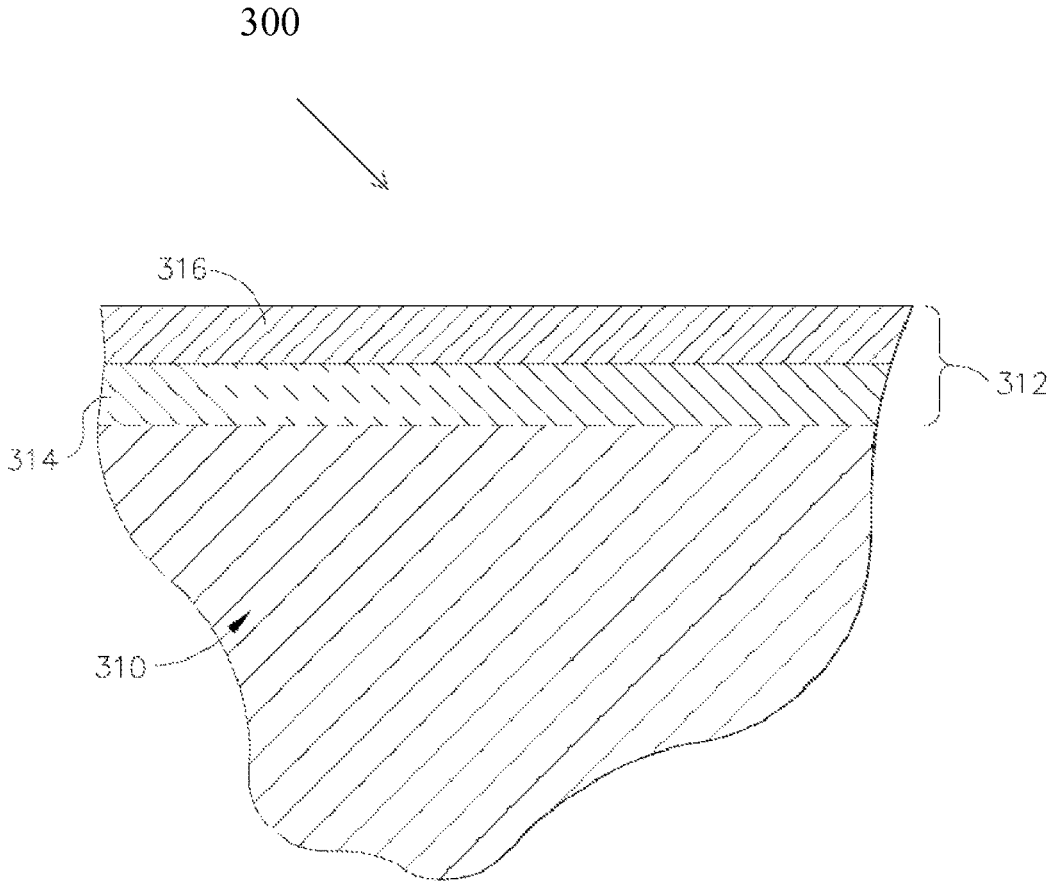
FIG. 3 is a cross section of a turbine component coated with a thermal barrier system comprising a bond coat and an overlay of a thermal barrier coating.

The current process 100, depicted in FIG. 1, requires stripping a turbine component 300, a cross section of which is depicted in FIG. 3 of its thermal barrier coating system. Stripping first requires removal of any TBC 316 that may overlie an aluminide bond coat 314, which in turn overlies a substrate 10. In a new turbine component, the aluminide bond coat 314 and the overlying TBC together form a thermal barrier coating system 312. While the TBC includes an intermediate aluminide bond coat completely underlying it, not all of the aluminide bond coat 314 is covered by the TBC 316. Removal of the TBS is the first step in refurbishing an article removed from service in a turbine. The TBC is removed by grit blasting, step 110. Typically, articles removed from service in a turbine that are coated with a TBC include but are not limited to turbine buckets, turbine vanes, shrouds, liners and combustors.

After removal of the TBC by grit blasting, step 110, the aluminide bond coat 314 must be removed from substrate 310 by removing minimal amounts of material from the substrate or by removing no material from the substrate. Since high temperature operations involve interdiffusion of bond coat elements and substrate elements, removal of the bond coat may also involve some reduction in the original substrate thickness, but the reduction in substrate thickness desirably is held to a minimum or no reduction at all The article, in step 120 is then dipped in an acid solution, such as a 20-40 weight percent nitric acid solution, for 15 minutes, the acid reacting with the aluminide coating. Unless otherwise specified, all compositions and solution strengths identified herein in weight percent. If the article includes cooling holes, such as are typically included in turbine buckets and other hot section components, it may be necessary to mask the cooling holes prior to immersion into the acid solution to preclude damage to the interior surfaces of the component.

The article is then grit mechanically removed, such as by grit blasting in step 130, the reaction product from the surface of the substrate formed during the immersion into the acid solution in step 120. The article may be immersed in a caustic solution for 1-4 hours before dipping in the acid solution, and also may be dipped in the caustic solution for up to 2 hours after step 120, the caustic solution being maintained at an elevated temperature in the range of 140-212° F. (60-100° C.).

After grit blasting, the article is inspected and re-masked, as required, step 140(*a*) and 140(*b*). The acid dip, step 120, grit blasting 130 and masking (140(*a*) and 140(*b*)) and optional caustic dip are repeated, as even aggressive grit blasting does not remove the tightly adherent reaction product after a single cycle. Three cycles are required to fully remove the aluminide bond coat. After the last grit blast, the article is given a final immersion in an acid solution 150 which may be followed by a dip or a water spray to neutralize the acid. The current process is time consuming, requiring up to 23 hours per set of turbine buckets (nearly 70 hours for a three turbine set) to accomplish. In addition, aggressive grit blasting risks removing substrate material that results in unnecessary scrapping of articles as a result of thinning.

Figure 2:
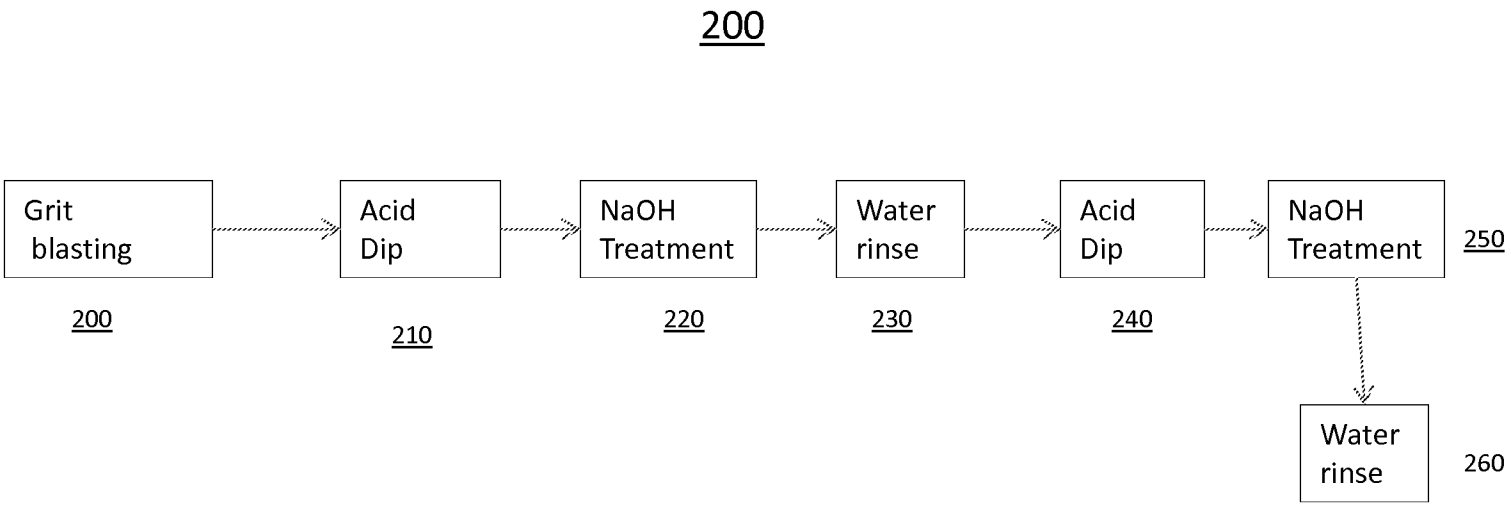
FIG. 2 is a flow chart of the present invention for removing smut from article substrates as the bond coat forms a smut during bond coat removal.

The process of the present invention simplifies the stripping operation and shortens the cycle time, which also saves money in labor and materials costs. Referring now to FIG. 2, the process 200 of the present invention is set forth.

An article, such as a turbine component, and preferably turbine buckets having cross-sections such as shown in FIG. 3, after removal from service in a turbine, are stripped of the TBC 316 by a conventional grit blasting operation. 200. The turbine component, preferably turbine buckets, are stripped of their TBC 316 and immersed in a solution of $HCl/H_3PO_4$ at a predetermined temperature for a predetermined time, step 210. The solution comprises about 25-35% HCl, about 30-40% $H_3PO_4$ and the balance water. Preferably, the solution comprises about 30% HCl, about 35% $H_3PO_4$ and the balance water. The solution is maintained at a predetermined temperature in the range of 150° F.±5° F. (about 66° C.±2.8° C.). The amount of time that a turbine component is immersed in the hot $HCl/H_3PO_4$ solution depends on the thickness of the coating. A thicker coating requires a longer time. However, the immersion times fall in the range of 1-6 hours. The $HCl/H_3PO_4$ reacts with the aluminide bond coat to form what is characterized herein as smut on the surface of the component. In one analysis, the smut comprises about 4% aluminum (Al), 23% chromium (Cr), 26.71% cobalt (Co), 15% nickel (Ni), 28% oxygen (O), less than 1% silicon, less than 1% chlorine (CI), less than 1% calcium (Ca) and less than 1% titanium (Ti).

The turbine component 300, preferably a set of turbine buckets, is then transferred, substantially immediately after removal from the $HCl/H_3PO_4$ solution, into a solution of NaOH at room temperature, step 220, for a preselected time at a preselected concentration for a predetermined time. While the NaOH temperature may be monitored, it is not necessary, as room temperature generally includes temperatures from about 60° F. to about 90° F. (about 15-32° C.) and preferably about 75-77° F. (about 25° C.). The NaOH serves as a desmutting agent to remove the smut from the surface of the substrate 310. The NaOH is maintained at a preselected concentration in the range of about 15-30%. While the temperature of the NaOH solution may not require monitoring, the concentration is monitored to assure that it remains within the effective range, and is replenished if it falls below this range. Usually, the concentration does not rise above this range, as it receives the turbine component from the acid bath. The concentration may be monitored by measuring the pH and maintaining the pH above at least 10. The NaOH solution is recharged if the solution becomes too weak to perform its function as a desmutting agent. The predetermined time is about 1 hour±15 minutes.

Turbine component is then removed from the NaOH solution and dipped into a water bath maintained at a temperature of 90° F. (32° C.) or greater, step 230. The water is pH neutral and preferably monitored continuously and maintained by a reverse-osmosis process. Preferably the water in the bath is circulated vigorously to assist in removing any residual smut that may still be clinging to the component.

After the water dip, step 230, the blade is inspected. If any smut remains on the surface, the blade is treated by mechanically rubbing the surface lightly with a light abrasive such as Scotchgard®, a product line available from 3M of Minneapolis, Minn., who also is the owner of the trademark, or other mild abrasive cloth or very fine sandpaper (400 grit or finer).

As final steps to assure complete removal of the aluminide bond coat 314, the turbine component is immersed in a bath of $HCl/H_3PO_4$, step 240, to react with any residual aluminide bond coat. The immersion in step 240 is shorter than in step 210 to minimize any reactions of the $HCl/H_3PO_4$ with substrate that is not coated with the aluminide bond coat. The immersion in $HCl/H_3PO_4$ preferably in the range of 1 to 3 hours. The length of time for the immersion in step 240 will depend upon the results of a visual inspection after the first desmutting operation and any subsequent mechanical removal operations of residual smut. If visual inspection discloses significant amounts of residual aluminide bond coat, the step 240 immersion may be longer than 3 hours. Conversely, if the visual inspection after the first desmutting disclosed a substantial absence of aluminide bond coat, the immersion in $HCl/H_3PO_4$ may be reduced to 30 minutes. The bath of $HCl/H_3PO_4$ is maintained in accordance with the temperature and concentration requirements of the bath of $HCl/H_3PO_4$ utilized in step 210. While conceivably the same bath may be used for both operations, because process 200 is a batch process, it is preferred that the bath of $HCl/H_3PO_4$ in step 240 be a separate bath to avoid processing congestion which could lengthen overall processing time.

Turbine component 300 is then removed from the $HCl/H_3PO_4$ bath and immersed into another bath of NaOH, step 250. The NaOH solution in step 250 is maintained in accordance with the temperature and concentration requirements of NaOH utilized in step 220. While conceivably the same bath may be used for both operations, because process 200 is a batch process, it is preferred that the bath of NaOH in step 250 be a separate bath to avoid processing congestion which could lengthen overall processing time.

Turbine component 300 is then removed from the NaOH and contacted with water, step 260. Turbine component 300 may either be immersed in a bath of water or may be rinsed/sprayed with water. Tap water may be used for this operation. Because the amount of time required for the water rinse/spray is short compared to other steps in the operation, the same water bath used in step 230 may be used for this operation. However, it is preferred that a separate water spray be used in step 260 as the additional pressure from a water spray provides a motive force of water that assists in removing any stubborn residual smut that may cling to the substrate.

The process of the present invention has been demonstrated to be useful for turbine components removed from service for refurbishment, including but not limited to GT bucket and nozzle repairs for GT33/GT39. The process has been demonstrated to reduce time for stripping for refurbishment by about ⅓ for turbine bucket sets (3) removed from service, from about 69 hours for three sets of buckets to about 46 hours. Similar time savings are expected for other turbine components. The cost savings for stripping for refurbishment is about $1335 per set of buckets, or about $4000 for a turbine engine having three sets of buckets. Similar cost savings are expected for other turbine components. This savings in material and labor costs does not include cost savings due to reduction in scrap rate resulting from excessive thinning of substrate parts resulting from excessive grit blasting in the current processing techniques. While the method 200 of the present invention does utilize an initial masking step, the present invention does not require masking of the cooling holes to protect them from damage due to aggressive grit blasting. Finally, the present invention has been found to be more environmentally friendly and safer for workers. The $HCl/H_3PO_4$ bath, even though maintained at an elevated temperature, is not as strong or aggressive as the acids utilized in the current process. The base utilized in the current process is limited to NaOH and does not utilize some of the stronger bases utilized in the current process or other prior art processes. Although the invention utilizes NaOH and the concentration overlaps that utilized in the current process and in other prior art processes, the maximum concentration of NaOH utilized in the present invention is less than the maximum concentration utilized in the current process or in other prior art processes. Also, the NaOH utilized in the present invention is maintained at room temperature, unlike prior art processes that utilize elevated temperature NaOH baths. Finally, the smut containing heavy metals, as evidenced by the chemical analysis set forth above, is substantially captured by the $HCl/H_3PO_4$ baths and the NaOH baths, so that heavy metal contamination can be readily filtered, unlike the current and prior art methods that utilize aggressive grit blasting that may contribute to airborne contamination.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for stripping a metallic bond coating from an article, comprising the steps of:

providing the article having the metallic bond coating applied over a surface of a metallic substrate, wherein the metallic bond coating is a MCrAlX metallic bond coating, wherein M is selected from the group consisting of Ni, Co, Fe, and combinations thereof and X is selected from the group consisting of Y, Ti, Ta, Re, Mo, W, B, C, Hf, and Zr;

immersing the article in a first solution consisting essentially of HCl, $H_3PO_4$, and water for a first immersion such that the first solution reacts with the metallic bond coating to form a first smut; then removing the article from the first solution and immersing the article in a second solution comprising NaOH to remove the first smut; then removing the article from the second solution and rinsing the article with water to remove any residual first smut; then immersing the article in the first solution for a second immersion such that the first solution reacts with any remaining metallic bond coating to form a second smut; then removing the article from the first solution and immersing the article in a third solution comprising NaOH to remove any additional second smut; then removing the article from the third solution.

2. The method of claim 1 further including the additional step, after removing the article from the third solution, of rinsing the article with water to remove any residual second smut and neutralizing the NaOH.

3. The method of claim 1 further including the additional steps of:

after providing the article, the article having the metallic bond coating comprising an aluminide bond coat, first masking any cooling holes in the article, then grit blasting the article to remove any thermal barrier coating overlying the aluminide bond coat.

4. The method of claim 1 further including a step of mechanically removing any residual first smut from the article after the first rinsing with water step.

5. The method of claim 1 wherein the step of providing the article having the metallic bond coating applied includes providing a turbine component selected from the group consisting of a turbine bucket, a turbine vane, a shroud, a liner, and a combustor.

6. The method of claim 1 wherein the step of immersing the article in the first solution includes immersing the article in the first solution at a temperature of 145-155° F.

7. The method of claim 1 wherein the first solution consists essentially of, in weight percent, 25-35% HCl, 30-40% $H_3PO_4$, and the balance water.

8. A method for stripping a thermal barrier coating and a metallic bond coating from an article, comprising the steps of:

providing the article having the thermal barrier coating overlying the metallic bond coating applied over a surface of a metallic substrate, the metallic bond coating being intermediate the substrate and the thermal barrier coating;

stripping the thermal barrier coating overlying the bond coating to remove the thermal barrier coating; then immersing the article in a first solution consisting of HCl, $H_3PO_4$, and water for a first immersion such that the first solution reacts with the bond coating to form a first smut; then removing the article from the first solution and immersing the article in a basic desmutting agent to remove the first smut; then removing the article from the basic desmutting agent and dipping the article in water at a temperature of at least 90° F. having a neutral pH; then inspecting the article; then mechanically removing any residual first smut from the article if residual first smut is identified during article inspection;

immersing the article in a second solution of HCl, $H_3PO_4$, and water for a second immersion such that the second solution reacts with any remaining metallic bond coating to form a second smut; then removing the article from the second solution and immersing the article in a basic solution to remove any second smut; then removing the article from the basic solution and contacting the article with water to remove any residual second smut.

9. The method of claim 8 wherein the step of stripping the thermal barrier coating includes grit blasting.

10. The method of claim 8 wherein the first solution consists of, in weight percent, 25-35% HCl, 30-40% $H_3PO_4$, and the balance water.

11. The method of claim 10 wherein the first solution consists of, in weight percent, 30% HCl, 35% $H_3PO_4$, and the balance water.

12. The method of claim 8 wherein the step of immersing the article in a basic desmutting agent further includes NaOH as the basic desmutting agent.

13. The method of claim 12 wherein the NaOH has a concentration, in weight percent, in the range of 15-30% and a pH above 10.

14. The method of claim 12 wherein the NaOH is maintained at a temperature in the range of 60–90° F.

15. A method for stripping a metallic bond coating from an article, comprising the steps of:

providing the article having the metallic bond coating applied over a surface of a metallic substrate;

immersing the article in a first solution consisting of HCl, $H_3PO_4$, and water for a first immersion such that the first solution reacts with the metallic bond coating to form a first smut then removing the article from the first solution and immersing the article in a second solution comprising NaOH to remove the first smut then removing the article from the second solution and rinsing the article with water to remove any residual first smut then immersing the article in the first solution for a second immersion such that the first solution reacts with any remaining metallic bond coating to form a second smut then removing the article from the first solution and immersing the article in a third solution comprising NaOH to remove any additional second smut then removing the article from the third solution.

16. A method for stripping a metallic bond coating from a turbine component removed from service, comprising the steps of:

providing the turbine component having the metallic bond coating applied over a surface of a metallic substrate;

immersing the turbine component in a first solution consisting of HCl, $H_3PO_4$, and water for a first immersion, wherein the first solution reacts with the metallic bond coating to form a first smut; then removing the turbine component from the first solution and immersing the turbine component in a second solution comprising NaOH to remove the first smut; then removing the turbine component from the second solution and rinsing the turbine component with water to remove any residual first smut; then immersing the turbine component in the first solution for a second immersion, wherein the first solution reacts with any remaining metallic bond coating to form a second smut; then removing the turbine component from the first solution and immersing the turbine component in a third solution comprising NaOH to remove the second smut; then removing the turbine component from the third solution.

17. The method of claim 16 further including the additional steps of:

after providing the turbine component, the metallic bond coating comprising an aluminide bond coat, first masking any cooling holes in the turbine component, then grit blasting the turbine component to remove any thermal barrier coating overlying the aluminide bond coat.

18. The method of claim 16 further including a step of mechanically removing any residual first smut from the turbine component after the first rinsing with water step.

19. The method of claim 16, wherein the step of providing the turbine component having the metallic bond coating applied over the surface of the metallic substrate includes providing the turbine component having the metallic bond coating selected from the group consisting of PtAl, NiPtAl, and NiAl.

20. The method of claim 16, wherein the step of providing the turbine component having the metallic bond coating applied over the surface of the metallic substrate includes providing the turbine component having the metallic bond coating as a MCrAlX metallic bond coating, wherein M is selected from the group consisting of Ni, Co, Fe, and combinations thereof and X is selected from the group consisting of Y, Ti, Ta, Re, Mo, W, B, C, Hf, and Zr.

21. The method of claim 16, wherein the step of providing the turbine component having the metallic bond coating applied includes providing the turbine component selected from the group consisting of a turbine bucket, a turbine vane, a shroud, a liner, and a combustor.

22. The method of claim 16, wherein the step of immersing the turbine component in the first solution includes immersing the turbine component in the first solution at a temperature in the range of 145-155° F.

23. The method of claim 16, wherein the first solution consists of, in weight percent, 25-35% HCl, 30-40% $H_3PO_4$, and the balance water.

24. A method for stripping a thermal barrier coating and a metallic bond coating from a turbine component removed from service, comprising the steps of:

providing the turbine component having the thermal barrier coating overlying the metallic bond coating applied over a surface of a metallic substrate, the metallic bond coating being intermediate the substrate and the thermal barrier coating;

stripping the thermal barrier coating overlying the bond coating to remove the thermal barrier coating; then immersing the turbine component in a first solution consisting of HCl, $H_3PO_4$, and water for a first immersion, wherein the first solution reacts with the bond coating to form a first smut; then removing the turbine component from the first solution and immersing the turbine component in a basic desmutting agent to remove the first smut; then removing the turbine component from the basic desmutting agent and dipping the turbine component in water at a temperature of at least 90° F. having a neutral pH; then inspecting the turbine component; then mechanically removing any residual first smut from the turbine component if residual first smut is identified during turbine component inspection;

immersing the turbine component in a second solution comprising HCl, $H_3PO_4$, and water for a second immersion, wherein the second solution reacts with any remaining metallic bond coating to form a second smut; then removing the turbine component from the second solution and immersing the turbine component in a basic solution to remove any second smut; then removing the turbine component from the basic solution and contacting the turbine component with water to remove any residual second smut.

25. The method of claim 24, wherein the step of stripping the thermal barrier coating includes grit blasting.

26. The method of claim 24, wherein the first solution consists of, in weight percent, 25-35% HCl, 30-40% $H_3PO_4$, and the balance water.

27. The method of claim 24, wherein the first solution consists of, in weight percent, 30% HCl, 35% $H_3PO_4$, and the balance water.

28. The method of claim 24, wherein the basic desmutting agent comprises NaOH.

29. The method of claim 28, wherein the basic desmutting agent comprises the NaOH at a concentration, in weight percent, in the range of 15-30%, and has a pH above 10.

30. The method of claim 28, wherein the basic desmutting agent is at a temperature in the range of 60-90° F.

* * * * *